United States Patent [19]

Hogan

[11] 3,953,948

[45] May 4, 1976

[54] HOMOHEDRAL CONSTRUCTION EMPLOYING ICOSAHEDRON

[76] Inventor: John P. Hogan, 704 Elm, Williamsburg, Iowa 52361

[22] Filed: Sept. 3, 1974

[21] Appl. No.: 502,839

[52] U.S. Cl. ..... 52/81; 46/25; 46/29; 52/237; 52/DIG. 10; 403/176

[51] Int. Cl.[2] ..... E04B 1/348

[58] Field of Search ..... 52/80, 81, DIG. 10, 52/237; 46/24, 25, 27, 28; 403/176

[56] References Cited

UNITED STATES PATENTS

| | | | |
|---|---|---|---|
| 2,839,841 | 6/1958 | Berry | 52/DIG. 10 |
| 3,411,250 | 11/1968 | Maymont | 52/81 |
| 3,461,574 | 8/1969 | Larsen | 52/DIG. 10 |
| 3,502,091 | 3/1970 | Corbin | 52/DIG. 10 |
| 3,660,952 | 5/1972 | Wilson | 52/81 |
| 3,722,153 | 3/1973 | Baer | 52/81 |
| D191,438 | 10/1961 | Paulson | 52/237 |

FOREIGN PATENTS OR APPLICATIONS

| | | | |
|---|---|---|---|
| 1,196,348 | 7/1965 | Germany | 52/81 |
| 848,389 | 9/1960 | United Kingdom | 52/DIG. 10 |

*Primary Examiner*—Ernest R. Purser
*Assistant Examiner*—Henry Raduazo

[57] ABSTRACT

Homohedral construction is a building and truss system based on the regular icosahedron. It is analogous to the standard building or truss system based on the cube, which is characterized by 90° corners and edges on its struts and planar surfaces.

37 Claims, 53 Drawing Figures

HOMOHEDRAL CONSTRUCTION EMPLOYING ICOSAHEDRON

Homohedral construction is based on the icosahedron's unique ability at three-dimensional pentangular intersection with another identical icosahedron along established coplanar line segments. This geometry translated into a truss system means a framework of generally straight, curved, helical or circular tubular form or combination thereof in which the main structural elements are interconnected to form a triangular grid surface with a plurality of five-edged convex vertices and a plurality of six, seven, eight, nine or ten-edged convex-concave vertices depending upon the form of the individual truss. Nevertheless the surface delineated by the new convex body or framework is still composed exclusively of identical equilateral triangular planes; which is the origin of my term "homo" (identical, same, equal) "hedra" (facets or surfaces). This geometry translated into a building system means a framework consisting of truncated icosahedra which are interconnected along their respective planes of truncation. These planes of truncation are where a cluster of five convex equilateral triangular planes occurring around a common vertex have been removed from the icosahedron, leaving a framework that has a face coplanar with the plane of truncation. When this truncation and interconnection occurs, a completely new and different convex body is formed, apart from the two or more original identical icosahedra. This new convex body's surface is still composed primarily of convex vertices identical in angular deflection, pitch and number of triangular planes clustered with the regular icosahedra; but it also contains a whole new set of convex-concave vertices occuring along the lines of truncation and intersection of the individual icosahedra members, created by the clustering of six, seven, eight, nine or ten equilateral triangular planes depending upon how many truncation-intersections are tangent with the individual vertices.

As a truss system, homohedral construction would be composed of identical structural elements interconnected with or without the aid of identical joint plates. Gusseting the convex-concave vertices would be necessary, but could be done quite easily by using a single five edged convex joint and strut vertex which would be attached internally by way of its struts to a set of co-planar convex-concave vertices.

Although the standard 90° truss system may use identical joint plates, its structural elements could and would probably be of different lengths and certainly its gusseting would be done with specialized structural elements not identical to the main structural elements. Not only would it be more vulnerable to any type of tension-compression loads, due to lack of thorough triangulation, the 90° truss system would also be more expensive to produce than a homohedral truss because of its less uniform parts. Also a homohedral truss can be helical or circular or any other of many curved forms impossible to duplicate with a standard 90° truss, but which could be quite valuable in some load bearing endeavors.

Like the standard building system, homohedral construction has standardized and uniform components. Where I beams, 2×4's and rectangular bricks are the backbone upon which a standard building is built, a basic set of identical struts and equilateral triangular panels are the backbone of a homohedral building. The characteristic uniformity the standard building system possesses within itself allows for it to be mass-produced and marketed quite inexpensively; homohedral construction also possesses a characteristic uniformity within itself which allows for it also to be mass-produced and marketed quite inexpensively. Homohedral construction is also similar to the standard building system in that it is not limited to any single form or size. Infinite varieties and building variations are possible with the homohedral structural system just as with the standard building system. This is said so as not to confuse the homohedral system with the geodesic dome or other spheroid polyhedral construction systems where the form of the building is limited to a regular or elliptical spherical section though the method of further triangulating large triangular faces in a convex manner could certainly be used on the individual triangular surfaces of a homohedric building as they could on any triangulated structure whatever its overall shape may be.

There are differences between the homohedral system and the standard system of building construction, and in these differences are many concepts which work to the advantage of the homohedral construction system.

Since the surface of any homohedral building is composed exclusively of identical equilateral triangles, this allows for a degree of simplicity in manufacture. A standard building will have 90° corners on its surface, but the surface can be of any shape from square to exaggerated rectangular. Likewise even though there is more than one dihedral angle used in the framework elements of a homohedral building (actually there are three) all of the dihedral angles necessary can be fitted onto a single four-edged strut which is analogous to the 2×4 of a standard building. But here too the homohedral building strut for any single building will be of a uniform length, whereas the standard building will need many different lengths of 2×4's or its equivalent in its framework. So again the basic homohedral strut allows for a degree of simplicity in manufacture and construction not seen in the standard building system.

In the standard building system, the base of any individual structure is a flat plane, because a maximum utilization of the structure's interior space is gained by using a plane as its base. Therefore for the structure to sustain its integrity a foundation needs to be present to support the base plane in its proper attitude. Otherwise the structure is sure to heave and possibly break up, since so much of its surface is exposed to gravitational damage. The typical homohedral building would not have a plane for its base, in fact the majority would have a set of vertices for their bases because by doing so a maximum utilization of the structure's interior space would occur. Each of these vertices would be structured entirely of triangles. Thus, for the base of the majority of homohedral buildings the framework will be totally triangulated and the actual points of contact of the building with its base will be just that — a set of points. Thus there is a minimum of exposure of the structure to the shifts and upheavals of the base upon which it is resting, but even so the points upon which the homohedral building rests are supported by a convex triangulated structure, which will be the best suited to sustain any shift or upheaval and remain unchanged.

In the standard building system modifications need to be built in the framework and planar surfaces to create a pitched roof. This is because a pitched roof surface is not natural to a 90° cube-based system — that is unless the base of the structure is pitched also, with the resulting loss of most of the structure's livable interior space. A homohedral building does not have this problem of modification. By its very nature, the part of the structure which will be used as the roof is already pitched. There is no need for modification in any of the framework or planar surfaces. Thus an extra construction expense is eliminated which will certainly make any homohedral building competitive with any standard building of comparable size.

Also the ease with which a homohedral building can be added onto surpasses any procedures for additions to a standard building. Since in the homohedral system congruent icosahedral structures are interconnected along pentangular co-planar strut or line segments, any existing homohedral building can have one of its appropriate convexly triangulated vertices removed along with the five equilateral triangles it is composed of. Onto this exposed pentangular framework, consisting of the strut's primary mating edge, gusset members and another new icosahedral structure can be attached, which thereby produces an addition to the existing structure.

Thus my object in creating the homohedral construction system is to produce a building system that is competitive with the standard building system in material and construction cost, but surpasses the standard system in strength, expandability and ease of building site preparation. What this means is that a superior type of housing can be offered to low and moderate income people at a price competitive with or cheaper than the present type of housing available.

Further objects and advantages of the invention will be set forth in the following description made in connection with the accompanying drawings, in which.

Figure 13A:
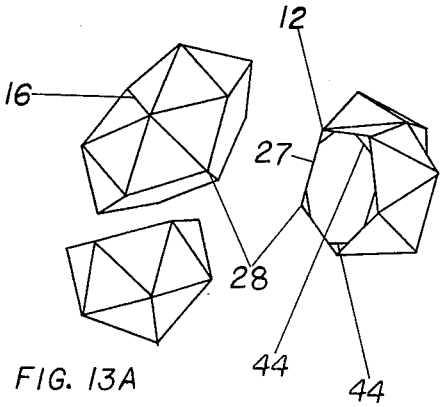
Figure 13B:
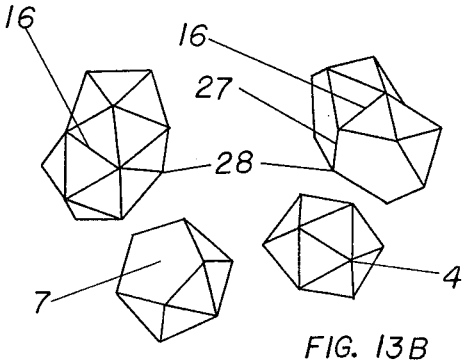

FIG. 13*a* and *b* are two diagrammatic perspective views of the formation of a ten-edged convex-concave vertex, FIG. 13*a* shows the nearly final arrangement among five truncated icosahedra and FIG. 13*b* shows the final arrangement among six truncated icosahedra.

Figures 14A, 14B, 15A, 15B, 16A, 16B, 17A, 17B, 18A, 18B, 19A, 19B:
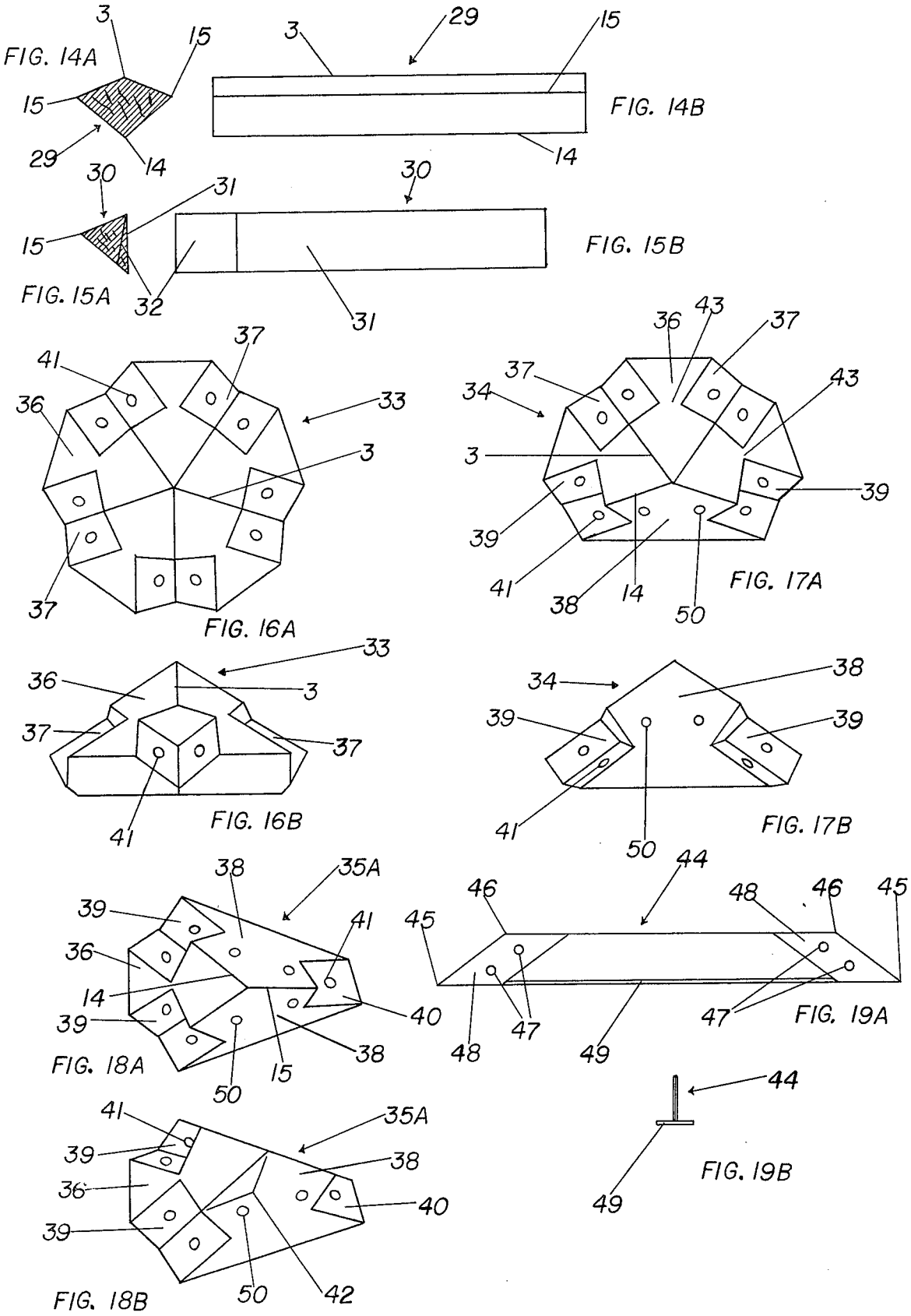

FIG. 14*a* and *b* are end and side views of the basic homohedral strut.

FIG. 15*a* and *b* are end and side views of a "ripped" homohedral strut.

FIG. 16*a* and *b* are top and side views of a convex homohedral joint.

FIG. 17*a* and *b* are top and side views of the primary mating joint.

FIG. 18*a* and *b* are top and side elevational views of the secondary mating joint. FIG. 19*a* and *b* are side and end views of a gusset to be used in bracing proximity of either the primary or secondary mating joints.

Figure 20:
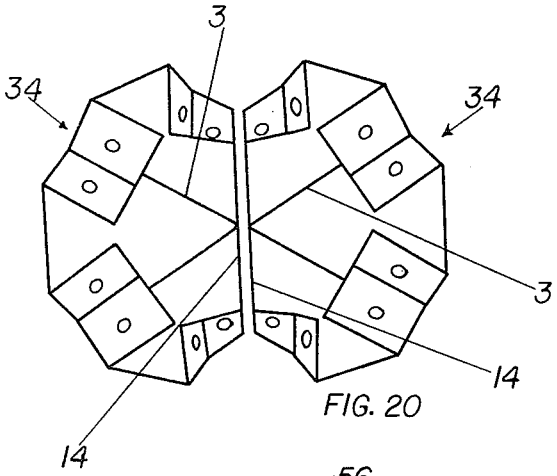

FIG. 20 is a top view of two primary mating joints in position to produce a six-edged convex-concave vertex.

Figure 21:
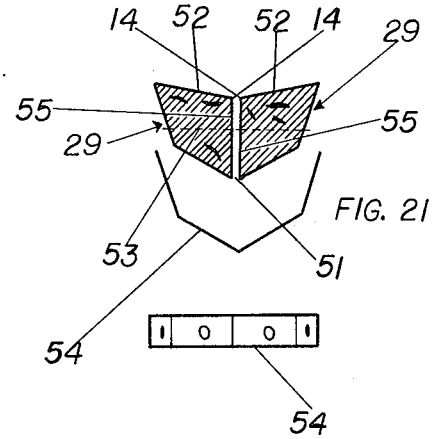

FIG. 21 is an end view of two homohedral struts in position to form a simple concave edge segment and a top and side view of a strapping member to aid in holding the two struts together.

Figure 22:
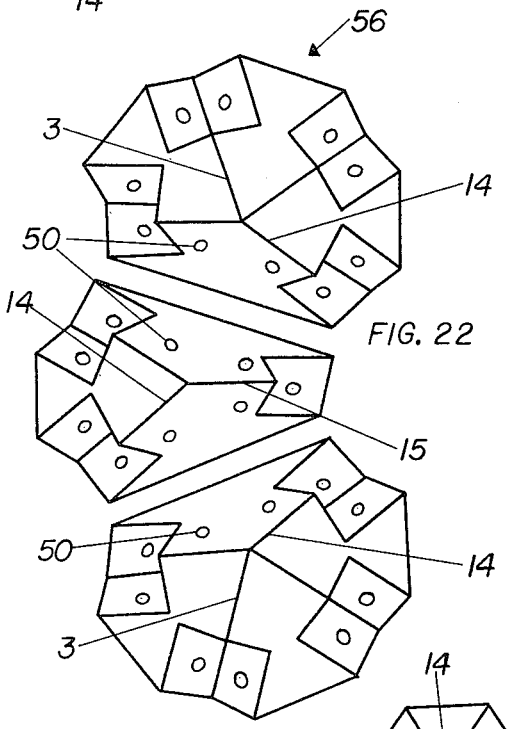

FIG. 22 is a top view of two primary mating joints and one secondary mating joint in position to produce a seven-edged convex-concave vertex.

Figure 23:
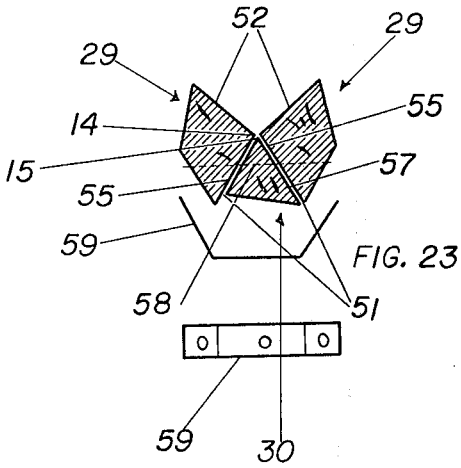

FIG. 23 is an end view of two homohedral struts and one strut fragment in position to form a double concave edge segment and a top and side view of a strapping member to aid in holding the three struts together.

Figure 24:
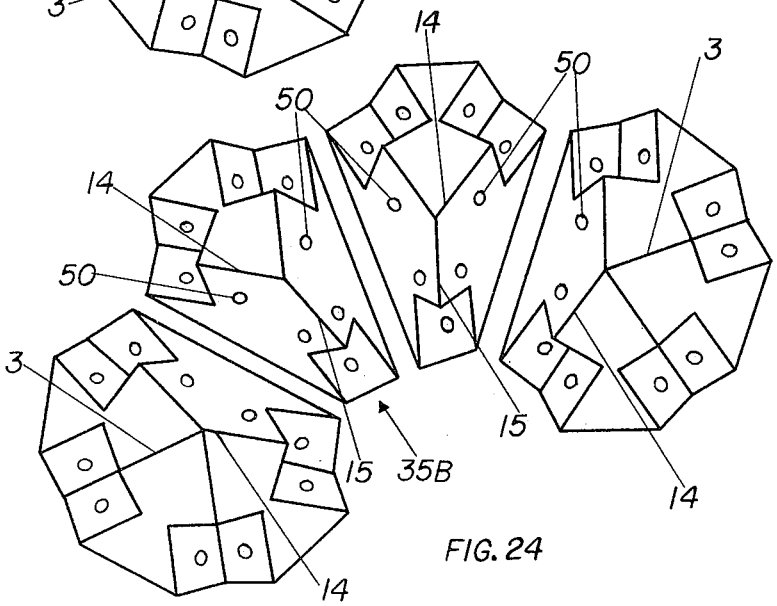

FIG. 24 is a top view of two primary mating joints and two secondary mating joints in position to produce an eight-edged convex-concave vertex.

Figure 25:
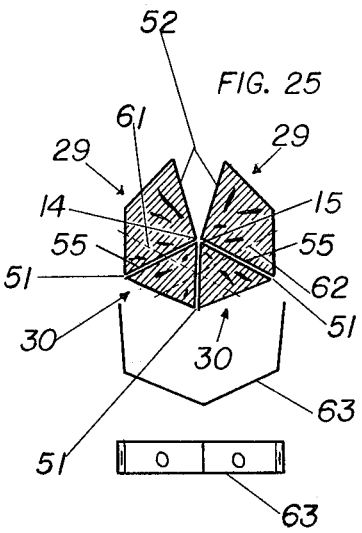

FIG. 25 is an end view of two homohedral struts and two strut fragments in position to form a triple concave edge segment and a top and side view of a strapping member to aid in holding the four struts together.

Figure 26:
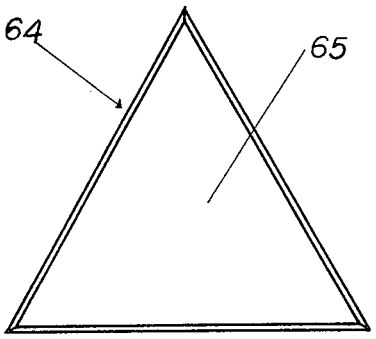

FIG. 26 is a bottom view of a convex beveledged surface panel.

Figure 27A:
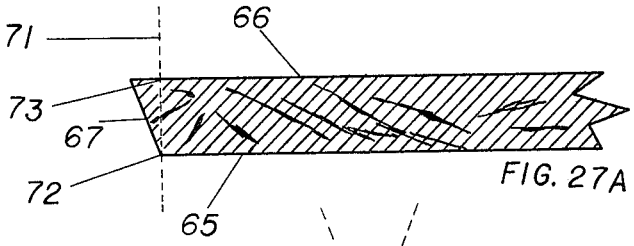
Figure 27B:
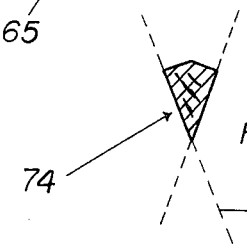

FIG. 27*a* and *b* are a vertical bisecting cross section of a convex bevel edge, and an end view of a convex edging strip.

Figure 28A:
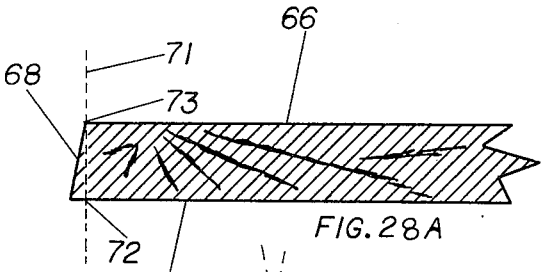
Figure 28B:
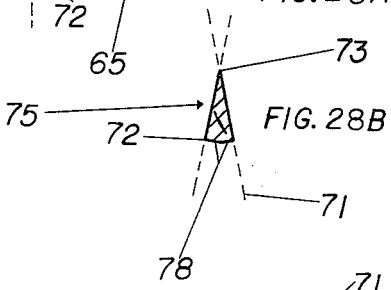

FIG. 28*a* and *b* are a vertical bisecting cross section of a simple concave bevel edge, and an end view of a simple concave edging strip.

Figure 29A:
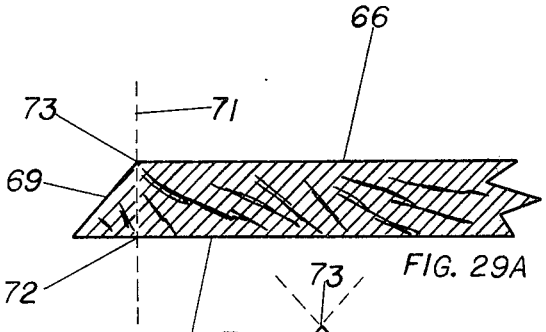
Figure 29B:
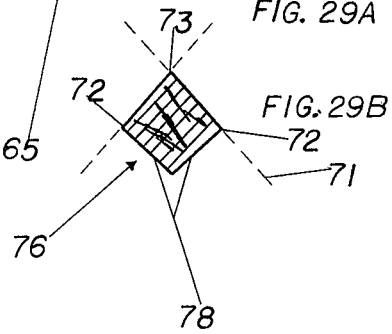

FIG. 29*a* and *b* are a vertical bisecting cross section of a double concave bevel edge, and an end view of a double concave edging strip.

Figure 30A:
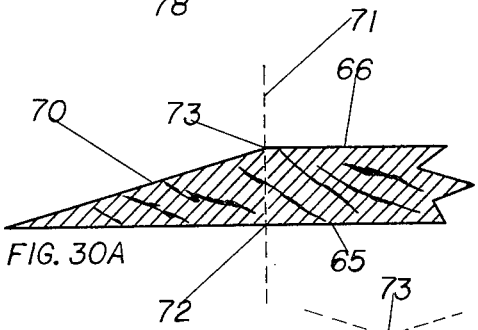
Figure 30B:
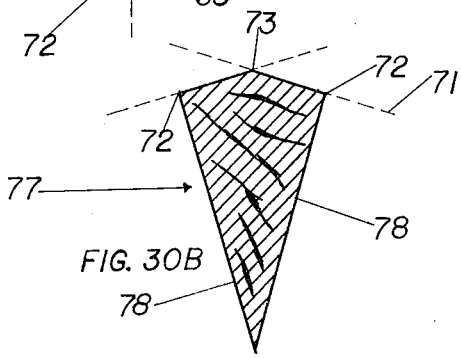

FIG. 30*a* and *b* are a vertical bisecting cross section of a three times (triple) concave bevel edge, and an end view of a triple concave edging strip.

Figures 31, 32, 33, 34, 35A, 35B, 36, 37A, 37B, 38, 39, 40:
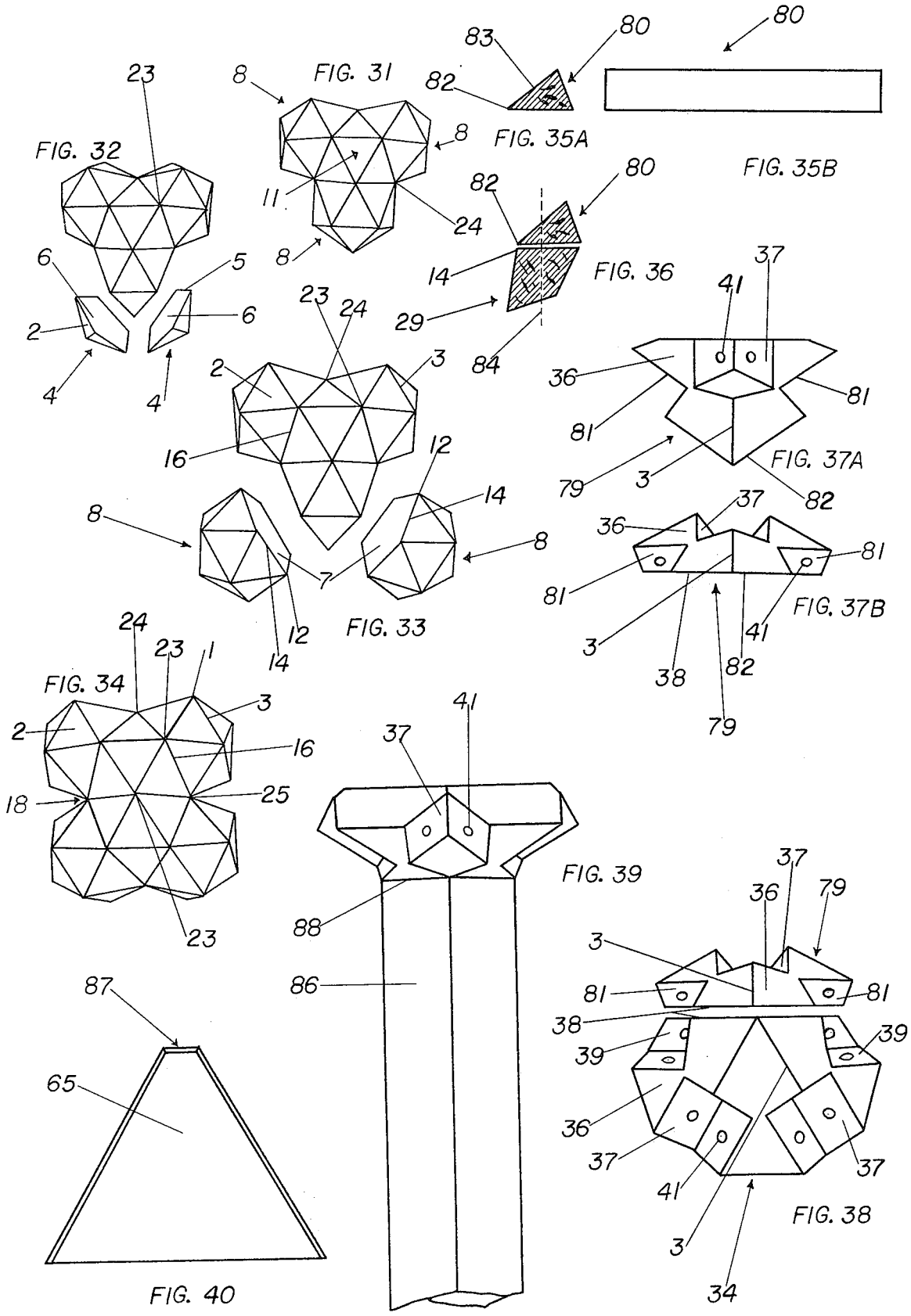

FIG. 31 is a diagrammatic top view of a homohedral structure consisting of four interconnected truncated icosahedra, the manner of truncations to be described.

FIG. 32 is a diagrammatic top view of the homohedral structure of FIG. 31 from which two pentacaps have been removed.

FIG. 33 is a diagrammatic top view of the homohedral structure of FIG. 32 to which two truncated icosahedra are to be attached, the manner of truncations to be described.

FIG. 34 is a diagrammatic top view of a homohedral structure consisting of six interconnected truncated icosahedra, the manner of truncations to be described.

FIG. 35*a* and *b* are an end and side view of a detachable cap strut.

FIG. 36 is an end view of a basic strut and a detachable cap strut in their proper attachment positions.

FIG. 37*a* and *b* are a top and side view of a detachable cap joint.

FIG. 38 is an elevational view of a primary mating joint and a detachable cap joint in their proper mating positions.

FIG. 39 is a side view of a supporting column incorporated into a convex joint.

FIG. 40 is a bottom view of a truncated triangular panel for use with the column-supported convex joint of FIG. 39.

Although a set of identical icosahedra will not fit together face to face and completely fill the space between their tangent surfaces, like the cube or the tetrahedron-octahedron lattice do, the icosahedron does have a method of space filling interaction unique to itself. Its method is to have two or more identical icosahedra intersect with each other along established pentangular coplanar line segments occurring as convex edges between any triangular planes of its surface. This intersection creates a new, three dimensional, convex figure shared by both intersecting icosahedra consisting of two clusters of five equilateral triangular planes (pentacaps) forming two separate and opposite vertices which share a common pentangular perimeter edge along their co-tangent pentangular bases. This concept of geometrical intersection is purely an abstraction when it comes to describing a construction system. Instead of intersecting icosahedra it would be preferable to work with truncated icosahedra.

Figure 2:
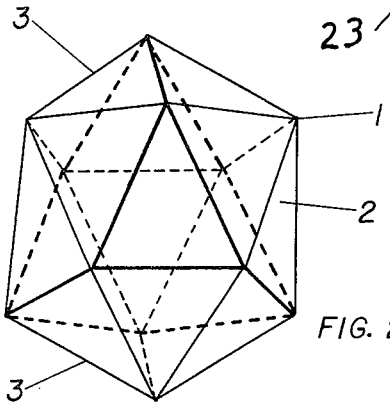
FIG. 2 is a diagrammatic perspective view of an icosahedron with three tangent planes of intersection delineated.
Figure 3:
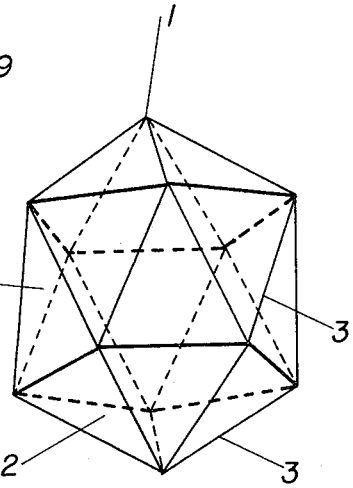
FIG. 3 is a diagrammatic perspective view of an icosahedron with two parallel planes of intersection delineated.
Figure 4:
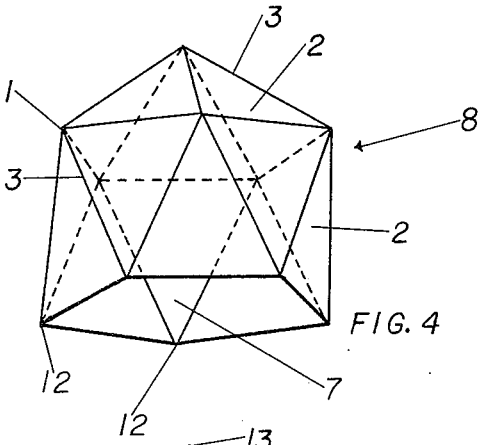
FIG. 4 is a diagrammatic perspective view of a once truncated icosahedron, the manner of the truncation to be described.
Figure 5:
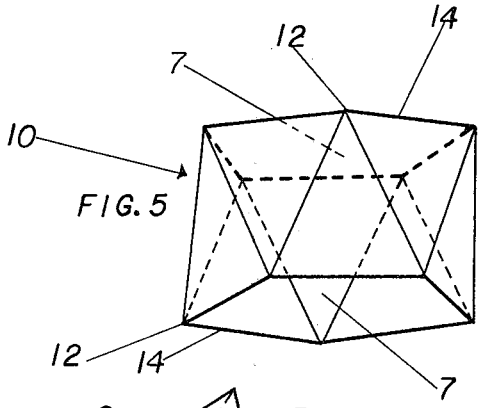
FIG. 5 is a diagrammatic perspective view of a parallel truncated icosahedron, the manner of the truncations to be described.
Figure 6:
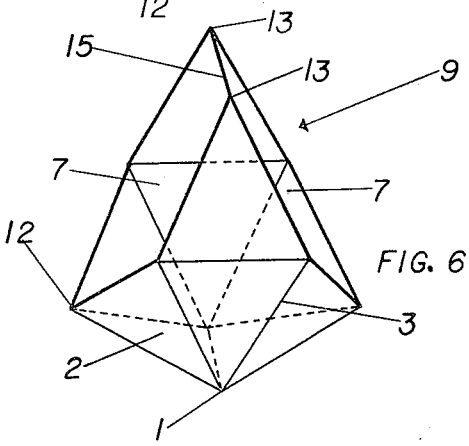
FIG. 6 is a diagrammatic perspective view of a twice (non-parallel) truncated icosahedron, the manner of the truncations to be described.
Figure 7:
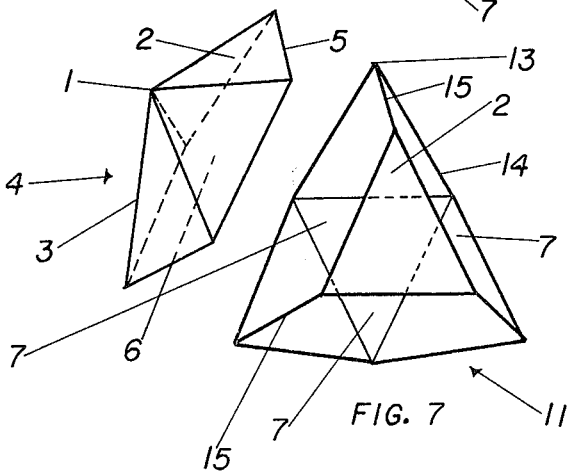
FIG. 7 is a diagrammatic perspective view of a detached pentacap and a three times truncated icosahedron, the manner of the truncations to be described.
Figure 8:
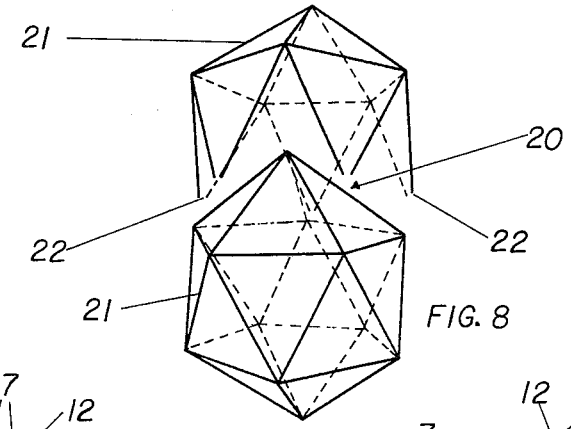
FIG. 8 is a diagrammatic perspective view of the icosahedral interconnections needed for the construction of a homohedral truss.

FIGS. 2 and 3 show two identical icosahedra, each composed of twelve identical vertices 1, thirty identical edges 3 and twenty identical equilateral triangular plane surfaces 2. Around each vertex 1 is clustered five equilateral triangular planes 2 (pentacaps). Now considering the vertex of a cluster (pentacap) 4 to be the apex 1 of each triangle, the triangular edge opposite of the vertex would then be the base of not only the individual triangle but also a segment 5 in the overall base of the cluster (pentacap) 4 itself. The entire cluster around any one vertex would have a coplanar pentangular base 6 made up of the individual bases 5 of the individual triangles in the cluster.

In any icosahedron there exists three individual but tangent coplanar pentangular bases 6 of three pentacaps 4 (type A truncation), FIG. 2, or two parallel individual coplanar pentangular bases 6 of two opposite pentacaps 4 (type B truncation), FIG. 3. When any or all of the individual pentacaps 4 are removed from the individual icosahedron, FIGS. 4–7, the planes of truncation 7 are coplanar with the planes of the bases 6 of the original individual pentacaps 4 When these truncated icosahedra, FIGS. 4–7, are fitted together, truncated pentangular plane to truncated pentangular plane 7, so that the resulting convex figure has a totally equilateral triangular surface, FIG. 1, what is created is not a composite figure but a figure complete and whole within itself. Along the supposed planes of truncation-interconnection are not mated planes, but a coplanar pentangular line segment 19 which defines a portion of the figure's surface which is concave. These line segments 19, combined with the remaining line segments present on the figure's surface 3 (running along convex edges), are the lines the structural elements follow in homohedral construction.

By its very triangulated nature, every homohedral structure, be it truss or building, is rigid, except for the one small area where the imaginary matings of the truncated icosahedral surfaces 7 occur. This coplanar pentangular line segment 19 defines a portion of the figure's surface which is concave and whose vertices are not convex (which would impart rigidity to the structure) but a combination convex-concave, FIG. 1–23 and 24, which allows for movement of the structural elements at the vertex. To overcome this problem any convex-concave vertex 23 and 24 must be gusseted. By gusseting, a convex-concave vertex is for all practical purposes transformed into two convex triangulated vertices that are interconnected. Therefore, by using a gusset, FIG. 13*a*–44, rigidity is restored to the vertex.

The simplest of the homohedral structures to form is the truss. In my preferred embodiment, the structural elements are tubes or rods 21 which can be welded or bolted endwise to one another to form the structural vertices. The gusset 20 element is nothing more than an icosahedral pentacap FIG. 8 composed of tubes or rods 21 identical to those used as structural elements, attached to the interior of the structure's convex-concave coplanar vertices, though more conventional elements like in FIG. 13*a*–44 could be used. In actual construction sequence this would mean first constructing an icosahedron out of welded or bolted tubes, then constructing an icosahedron fragment from which one pentacap 4, including its pentangular structural base 6 has been removed. The ten unconnected tube ends (arranged into five pairs) 22 would then be welded or bolted to five coplanar vertices on the icosahedron, resulting in the formation of five coplanar convex-concave vertices 23 which are braced or gusseted FIG. 8 by an internally connected pentacap. This procedure would be repeated, welding or bolting new icosahedron fragments to different sets of five coplanar vertices that define the base of a pentacap, until the desired structure is achieved.

It should be noted that the structural elements can also be used with joint elements. One specific method would be to use my Icosahedron Disc. U.S. Pat. No. 3,844,664, in forming all the convex icosahedral vertices, and by attaching the loose strut ends 22 of the icosahedron fragment to the strut ends of the gusset pentacap FIG. 8–20 opposite the vertex in forming all the convex-concave vertices. Planar structural elements can be used also, in which the edges of the planes are parallel to the line segments running from vertex to vertex — except for the open edges of the icosahedral fragment which has edges parallel to the planes of the pentacap used as an internal gusset, to which it is rigidly attached at its (the pentacap's) base. Any of many planar structural materials could be used, from plywood to plastic to sheet metal. My preference is for steel or aluminum sheet metal, pop riveted at its edges.

Although there is only one type of convex vertex in a homohedral structure, there are five different and individual convex-concave vertices possible; the simplest being the six-edged convex-concave FIG. 9–23, the most complicated being the ten-edged convex-concave FIG. 13–28, and falling in between the two extremes, the seven- 24, eight- 25, and nine- 26 edged convex-concave vertices.

Figure 9:
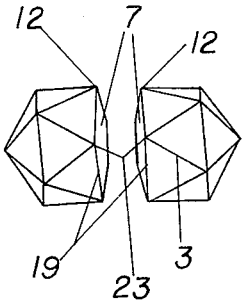
FIG. 9 is a diagrammatic perspective view of the formation of a six-edged convex-concave vertex between two truncated icosahedra.

Imagining again that a homohedral structure is made up of an interconnected group of truncated icosahedra, these five convex-concave vertices can be seen and understood clearly. FIG. 9 shows two single truncated icosahedra with their planes of truncation 7 parallel and facing each other. Each of the five truncated vertices (to be called primary vertices) 12 on one of the truncated icosahedra lies directly opposite its equivalent on the other truncated icosahedron. When the two parallel planes of truncation 7 are mated, the two pentangular planes of all the primary vertices 12 are absorbed by the interior of the structure, leaving only their composite surface planes consisting of six equilateral triangles 23, three donated from each of the mated primary vertices. The five resulting vertices have four convex edges 3 and two concave edges extending from each of them, the two concave edges being two segments on the plane of intersection 19 between the two truncated icosahedra. These concave edges 16 are called simple due to the fact that they are shared by only two truncated icosahedra (see FIG. 1–16).

Figure 10:
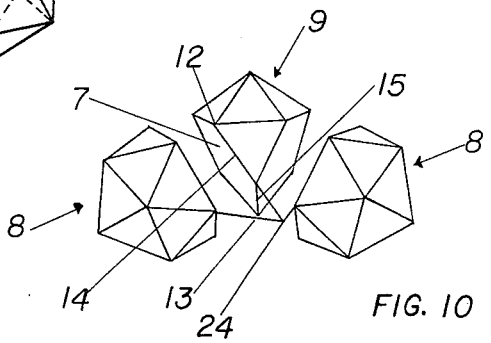
FIG. 10 is a diagrammatic perspective view of the formation of a seven-edged convex-concave vertex among three truncated icosahedra.

FIG. 10 shows two single truncated icosahedra 8 and one double truncated icosahedron of the A type (tangent truncations) 9. Along the planes of truncation of the double truncated icosahedron are present two different types of truncated vertices and two different types of truncation edges. The majority of the vertices are those composed of the edges of three equilateral triangular planes and one pentangular plane and are called the primary vertices 12, but two of the truncated vertices are composed of the edges of just one equilateral triangular plane and two pentangular planes, so they will be called the secondary vertices 13. The two secondary vertices share a common edge which is also the edge shared by the two planes of truncation, it will be called the secondary edge 15; the remainder of the edges on the planes of truncation are called primary edges 14. When the double truncated icosahedron 9 is wedged in between the two truncated icosahedra of FIG. 9, the two single truncated icosahedra 8 take a position similar to that seen in FIG. 10, where each of their planes of truncation 7 is parallel to one of the two planes of truncation of the double truncated icosahedron 9. If the three are interconnected the resulting figure has six six-edged convex-concave vertices connected to one another and other convex-concave vertices by eight simple concave edges 16, and two seven-edged convex-concave vertices 24, each composed of four convex and three concave edges, one of the concave edges being a double concave 17 and shared by the two seven-edged vertices. A double concave edge 17 exists where three truncated icosahedra or two primary edges and one secondary edge combine and share a common concave edge (see FIG. 1–17).

Figure 11:
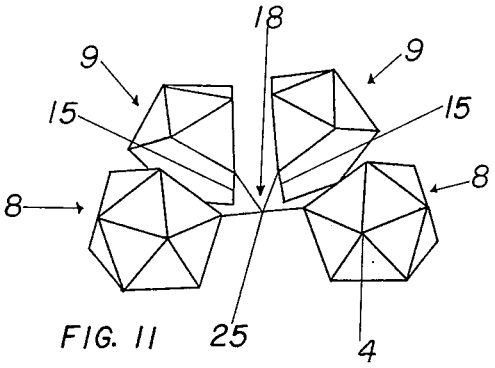
FIG. 11 is a diagrammatic perspective view of the formation of an eight-edged convex-concave vertex among four truncated icosahedra.

FIG. 11 reveals what happens when an additional double truncated icosahedron 9 of the A type is wedged between its equivalent and one of the single truncated icosahedra 8 of FIG. 10, so that its secondary edge 15 is parallel to and tangent with the secondary edge of its equivalent 15. The resulting figure has nine six-edged convex-concave vertices 23 connected to one another and other convex-concave vertices by twelve simple concave edges and two eight-edged convex-concave vertices 25, each composed of four convex and four concave edges, one of the concave edges being a triple concave 18 and shared by the two eight-edged vertices. The triple concave edge exists where four truncated icosahedra or two primary edges and two secondary edges combine and share a common concave edge. A triple concave edge is the highest degree of concavity possible, since at most only four truncated icosahedra can share a common concave edge.

Figure 12:
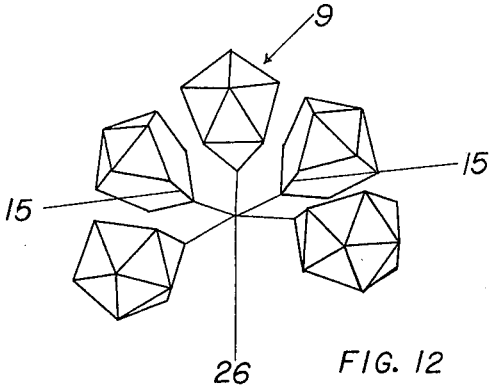
FIG. 12 is a diagrammatic perspective view of the formation of a nine-edged convex-concave vertex among five truncated icosahedra.

To make a nine-edged convex-concave vertex 26 a variation in the wedging of an additional double truncated A type icosahedron is necessary. As seen in FIG. 12, this double truncated icosahedron 9 is wedged in between its equivalents in FIG. 11, with their parallel co-tangent secondary edges, so that its secondary edge is not parallel to their equivalent secondary edges 15 and their secondary edges are no longer parallel and tangent to each other. Nevertheless all three non-parallel secondary edges do share a common point of tangency 26 where their ends meet one another and help form a nine-edged vertex. The resulting figure has ten six-edged convex-concave vertices connected to one another and other convex-concave vertices by fourteen simple concave edges, three seven-edged convex-concave vertices with their three double concave edges meeting at a common point 26 which is a nine-edged convex-concave vertex composed of two additional concave edges (simple concave) and four convex edges.

The most complex vertex — the ten-edged one — is formed when six truncated icosahedra, four double truncated of the A type and two single truncated, are interconnected so that two of the double truncated icosahedra share a common edge 27 created by the fusion of their two secondary edges, but that the two pairs are rotated on their plane of truncation-intersection with each other before further interconnection, so that only an end point 28 on each of their respective shared truncated edges is tangent with an end point of the other pair's shared edge. The figure is then completed when two single truncated icosahedra are interconnected with the remaining planes of truncation left on the central grouping (see FIG. **13*b*). The resulting figure has fourteen six-edged convex-concave vertices connected to one another and other convex-concave vertices by nineteen simple concave edges, two eight-edged convex-concave vertices with their two triple concave edges meeting at a common point which is a ten-edged convex-concave vertex 28** composed of four additional concave edges (simple concave) and four convex edges.

Figure 1:
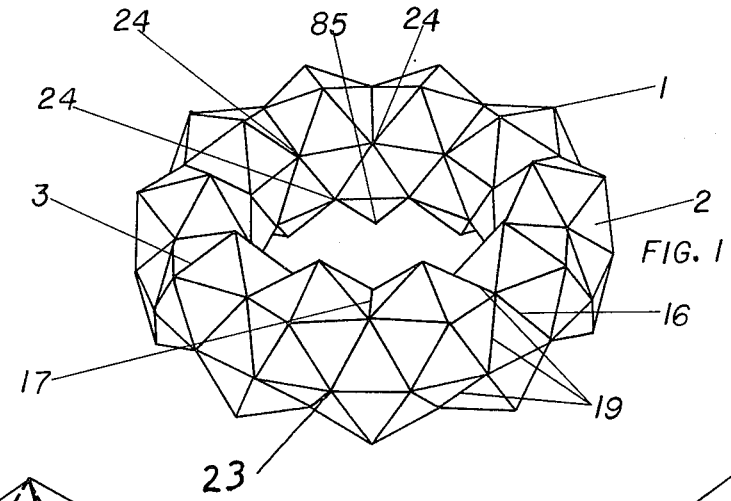
FIG. 1 is a diagrammatic perspective view of a product of the present invention — a homohedral ring.

For the sake of simplicity, all of these vertex-forming operations were done with only single 8 and double 9 truncated icosahedra. This leaves many independent pentacaps 4 on any of the example's surfaces which can be removed so that more homohedral interconnections can take place and more complex structures, though not vertices, can be realized. Even without the use of triple truncated icosahedra 11, some characteristic homohedral structural forms can be realized. By alternately rotating a seven-edged convex-concave vertex 24 among a group of twenty interconnected double truncated type A icosahedra 9, the homohedral ring FIG. 1 is formed. If instead of connecting single truncated icosahedra 8 to the central grouping in FIG. **13*b*, one connects a series of double truncated icosahedral pairs sharing a common secondary edge 27,** making sure that there is a continual unidirectional rotation of the intersecting planes, leaving only end points of the common secondary edges tangent, a homohedral helix is formed.

Though it has not been mentioned, the type B truncated icosahedron FIG. 5–10 (parallel truncation) is used mainly for extending any of the forms created by the type A truncated icosahedron 9 in its interaction with itself. Any plurality of type B truncated icosahedra 10 being interconnected will produce characteristic straight tubular structures. One unique quality of this type of truncation is that even though the forms of the truncated planes are congruent, they do not coincide in their positioning. Where there is a straight line segment 14 on the one plane, there will be centered an angle on the other 12. As a result, when two type B truncated icosahedra are interconnected, the plane of interconnection also serves as a bisecting plane of symmetry. When linearly extending a homohedral structural form, two interconnected type B truncated icosahedra must be used or else the form created by the type A truncated icosahedra in the figure will be altered by a slight rotation.

What is obvious is the small number of edges and vertices needed to perform all these twists and structural turns; one convex edge identical in dihedral angle to the edge found on the icosahedron 3, three concave edges varying in concavity from slight to acute 16, 17, 18; a convex vertex identical to the vertex of the icosahedron 1 and five convex-concave vertices ranging from a low of a cluster of six equilateral triangular planes forming a six-edged convex-concave vertex 23, to a high of a cluster of ten equilateral planes forming a ten-edged convex-concave vertex 28.

As was shown with the homohedral truss, all that is needed to construct a homohedral structure is a plurality of identical structural elements, be they elongate, like tubes or rods, or planar, like identical equilateral triangular planes made out of sheet metal. A variation in this structural simplicity could be quite advantageous — especially in constructing a homohedral structure to be used as a building. Instead of using an identical structural element in the same manner for both the convex and the concave edges of a homohedral structure, as is used in a truss, an identical structural element could be used in two different ways depending upon whether the structural edge was convex or concave, while at the same time providing structural surfaces coplanar with the triangular planes that comprise the surface of such a homohedral structure. The new structural element could be used by itself in forming the convex edge of the building, but would be used with other identical structural elements in the formation of the concave edges of the building, just as the various interconnections of the truncated icosahedra and their edges were shown to form the various concave surface edges of a homohedral structure.

Referring back to FIG. 6 it can be seen that there are three different edge types formed on that figure's type A double truncated icosahedral surface: one is the convex edge standard to icosahedrons 3, one is formed along the plane of truncation of the truncated icosahedron (primary edge) 14, and one is formed by the two tangent planes of truncation (secondary edge) 15.

Now although the convex edge, the primary edge and the secondary edge can be used by themselves, say in the form of angular steel elements analogous to angle irons in the standard building system which are interconnected edgewise, planar face to planar face in the case of the primary and secondary structural elements, and attached endwise through a set of vertex-forming joints whose structural surfaces are identical to the surfaces of the convex, the primary, and the secondary vertices which may also have uniform depressions along and on either side of their edges so that when the angular steel elements are attached and interconnected the resulting surfaces are uniform and, produce all the convex and concave edges and vertices on a homohedral structure, it would be preferable to combine all three edges on one structural element so that the element, by itself 29 or in a bisected ("ripped") form 30, can be used in producing all the necessary convex and concave edges. A plurality of these uniform structural elements could be interconnected by a small number of different vertex forming joints: one that would form the convex icosahedral vertices 33, one that would form the primary truncated vertices 34, and one that would form the secondary truncated vertices 35*a* or 35*b*. Instead of using internally attached pentacaps for gusseting 20 the coplanar convex-concave vertices, which would severely limit the amount of living space inside, a simple gusset FIG. 19*a* and *b*- 44 could be sandwiched between and rigidly attached to the two concave edge forming struts, very close to their common vertex, which would open up the structure's interior considerably. A plurality of triangular panels, whose planes of attachment are in the form of identical equilateral triangles FIG. 26- 65, could be used not only as means for enclosing the surface of the homohedral structural framework, but also to add further strength to it. And finally, since the concave pentangular line segments of a homohedral structure are created by the interconnection of two sets of structural elements along their congruent pentangular coplanar edges, the elements could be further modified so that a structural pentacap 4 could be detached from the homohedral structure FIG. 32, leaving a coplanar pentangular face 7 capable of expansion into a concave coplanar pentangular line segment 19 between the existing structure and an added homohedral portion FIG. 33.

I have found that I can substantially combine one convex edge 3, one primary edge 14 and two secondary edges 15 into a single structural element that I will call a homohedral strut FIG. 14*a*-29. The convex edge 3 of this strut is flanked on either side by the two secondary edges 15 and opposed by a primary edge 14. Each edge on the strut has a dihedral angle approximately 1°28′ less than their true values, which is well within surface tolerances necessary for the attachment of planar surface panels and interconnection among themselves. In any individual homohedral building structure a plurality of identical homohedral struts would be used — identical not only in cross section but also in length. In my preferred embodiment, the struts are made of wood, but they could be made of any strong and resilient material and could be a composite of several component elements: examples of the first would be extruded aluminum or rolled steel beams; examples of the second would be extruded aluminum beams which are in the shape of the bisected basic strut 30 and which are interconnected by nuts, bolts or any other means to form the basic strut 29, or rolled steel angle irons (of the homohedral variety) which are welded together to form the basic strut.

These homohedral struts are interconnected endwise to one another through a series of three vertex-forming joints whose edges correspond to the surface edges on the struts that will be used. Where a convex vertex FIG. 16*a* and *b*-33 is to be formed the joint will take the shape of a cluster of five equilateral non-coplanar triangular planes 36, which among themselves generate the convex dihedral angles present on the surface of a homohedral structure 3. Uniform depressions are made on each of the five joint edges 37 so that a homohedral strut fits into each of them so that each of their primary edges are tangent with the surface of each of the depressions and each of their convex edges are exposed and also continue and complete the localized surface of the joint in thich they individually appear.

Where a primary vertex FIG. 17*a* and *b*- 34 is to be formed, the joint will take the shape of a cluster of three equilateral triangular planes 36 and one regular pentangular plane 38 which has had four of its angles removed or altered by a diagonal truncation. Two different dihedral angles exist on the joint's four surface edges. Where an edge is formed between two equilateral triangles, the dihedral angle will be identical to the convex dihedral present on the surface of a homohedral structure 3, but where an edge is formed between an equilateral triangle and a truncated pentagon, the dihedral angle will be identical to that of the primary edge 14 as explained before. Depressions are made on each of the joint's edges, depending upon the type of edge it is. The convex edges are depressed 37 so that a homohedral strut will fit into each of them snugly with its convex edge exposed on the surface of the joint so that it continues and completes that edge and surface of the joint. The primary edges will be depressed 39 so that a homohedral strut will fit into each of them snugly so that its convex edge is tangent with the surface of the depression and its primary edge continues and completes that primary edge and surface of the joint.

Where a secondary vertex FIG. 18*a* and *b*-35*a* is to be formed the joint will take the shape of a cluster of one equilateral triangular plane 36 and two regular pentangular planes 38 which have had four of their respective angles removed or altered by a diagonal truncation. Two different dihedral angles exist on the joint's three edges. Where an edge is formed between an equilateral triangle and a truncated pentagon, the dihedral angle will be identical to that of the primary edge 14 on a truncated icosahedron as explained before; but where an edge is formed between two truncated pentagons, the dihedral angle 15 will be identical to that of the secondary edge on a truncated icosahedron. Depressions are made on each of the joint's edges, depending upon the type of edge it is. The primary edges are depressed 39 so that a homohedral strut will fit into each of them snugly so that the strut's convex edge is tangent with the surface of the depression and its primary edge continues and completes that primary edge and surface of the joint. The secondary edge is depressed 40 so that a homohedral strut, bisected from its primary edge to its convex edge FIG. 15*a* and *b*-30, will fit into the depression so that its plane of bisection 31 is tangent with the surface of the depression and its secondary edge 15 continues and completes the secondary edge and surface of the joint. By bevelling the ends of the bisected strut 32, so that looking at the strut endwise the secondary edge 15 seems to be the apex of an isoceles triangle while the bevelled bisection plane is the base 32, the need for more than one type of secondary joint is eliminated; otherwise two "mirror image" secondary joints are needed, depending upon which end of the bisected strut the joint is attached to (see FIG. 24-35*a* and *b*).

Within each of the depressions occur a plurality of apertures 41 through which bolts can be passed and used to fasten the struts to the joints: either directly to the apertures themselves or to nuts on the far side of the joints. Apertures 50 also occur on the mating planes of the primary and secondary joints so that two mating planes of two joints can be attached to one another. My joints have been made exclusively out of stamped sheet metal, thick enough in cross section to resist bending and warping as the framework is put together. The joints could be made out of many other materials from wood to molded plastics to cast or forged metal. The important quality that is necessary to preserve in any method of fabrication is the exact surfaces of the respective joints.

Another important consideration in fabricating the joints is the proper depth to which the struts are allowed to penetrate the joints. Although the exposed end of any one strut should be placed the same distance 42 from the vertex of the joint as all the other ends are, the initial tendency will be not to do this. The reason for this tendency not to place them equidistant from the vertex is because there will be gaps between the struts that look disproportionate 43. Only when the gaps between the struts are proportionate do they look proper, but it is a deceiving view, for in actuality while the struts look proper, the distances from strut end to vertex are unequal and improper. The joint to watch in setting up the whole joint-strut system is the secondary joint FIG. 18*a* and *b*. Once the strut end distance to the vertex 42 is set on this joint, the distances should be repeated on the other two joints FIG. 16*a* and *b* and FIG. 17*a* and *b* which, even though not congruent with the secondary joint, will be used with the secondary joint in interconnecting the identical lengths of struts to produce a homohedral building. Even though I don't use it myself, there is no reason why joint caps with identical, though slightly larger, surface areas, but without the characteristic edge depressions, could be fitted over the individual joint-strut complexes and attached to the joints to add further rigidity to the individual complexes.

One of the most important elements in the homohedral building system is the gusset element FIG. 19*a* and *b*- 44. Since in a building system a maximum of livable interior space is demanded, the gusset will be quite small in comparison to the one used in homohedral trusses 20. It is simply a rigid elongate member that attaches to two coplanar primary or secondary strut edge faces occurring just below a vertex joint (see FIG. 13*a*- 44). It need be attached to only one set of coplanar edge faces, if those 55 edge faces are to be rigidly interconnected to their equivalents on the intersecting framework. The gusset I use has end angles of 36° 45 and 144° 46, so that its end edges are parallel with the edges on the struts to which they are being attached. I use two apertures 47 on each end for ease in its attachment to the two mating planes it is sandwiched between, though only one aperture is necessary. The actual part of the gusset element that is sandwiched between the two mating edge faces, be they primary or secondary, is slightly thinner 48 than in the rest of the element. Furthermore a right angled bracing element 49 appears on the edge of the gusset pointing away from the vertex joint. Gussets must be used on every pentangular coplanar strut segment, even if three such planes are tangent along a joint-strut segment; in such an instance three gussets (see FIG. 34- 25) are needed in proximity to the joint for proper rigidity. My gusset is made out of steel, though I'm sure wood or any of many other materials would serve the same purpose.

Constructing the convex portion of a homohedral building frame is quite simple and straightforward, since there is only one joint used for any vertex and only one strut for any edge. Convex-concave vertices and concave edges are a different matter. There are as many different vertex combinations as there are convex-concave vertices, but there are only three strut combinations possible for producing concave edges. In actuality these strut combinations, along with their respective end-joint clusters, are the basis from which the other two convex-concave vertices are derived by simple rotation on their planes of intersection. So it is proper to describe these three combinations of struts and joints rather than just the total type of joints.

The simplest concave edge is formed when the primary edges 14 of two struts 29 are made tangent to one another so that both the edges and the two primary faces 55, one from each of the struts, are parallel and tangent FIG. 21, leaving the other two primary faces 52 to delineate the simple concave edge 16 on the structure's surface. These two struts can be nailed or screwed, but preferably bolted together through apertures spaced evenly along their lengths, the apertures passing through the two struts at approximately the position of the dotted line 53. Between 51 the two connected faces 55 of the struts will be placed and secured not only the gusset end 48, but also a form of watertight wadding or flashing material that will be in the shape of an approximately 3° wedge to compensate for the 1°28′ discrepency of the strut edges. The joint elements 34, which will take the position in FIG. 20, will have the struts 29 attached to them before the struts are connected together. One joint will be completely loaded with struts, gusseted and in its final working position in the framework. The other joint will only have the two primary edged struts attached to it while in a group of five coplanar struts and joints. I prefer to loosely attach the primary joints together first with nuts and bolts 50, then sandwich the wadding material between 51 the primary faces before passing bolts through the two struts 53, including a bolt through the second hole on the gusset end 47 and the removal of the short bolt from the first hole, and its replacement with a longer bolt through both mating struts. When all the bolts are loosely connected, the joint bolts 50 are tightened first, and then the bolts passing through the struts 53, making sure to tighten opposite bolts alternately. When all the struts and joints are interconnected firmly, I prefer to nail a set of inelastic metallic straps 54 to the interconnected struts for insurance against loosening bolts.

The next concave edge (double concave 17) to be formed is between two primary edges 14 and one secondary edge 15 of three homohedral struts FIG. 23. The secondary edge of the "ripped" homohedral strut 30 is wedged in between the two primary edged struts 29 in FIG. 21 so that all three edges are tangent and only two tangent primary faces 52 are present on the structure's surface, though at a different concave angle (double concave 17) to each other than before. The procedure for interconnecting the struts is similar to that used for the single concave edge. Gussets 44 are attached between any two mating surfaces 51, so that means two gussets 44 will be attached to each double concave strut-joint complex instead of one; furthermore, two lengths of wadding material will be used between the two planes of interconnection 51 in the strut complex. The joint elements, which will take the position as seen in FIG. 22, will be connected in succession, as done with the simple concave edge, rather than simultaneously. The secondary joint 35*a*, and its respective fragment of the structure, will be attached to the "loaded" primary joint 34 in a rigid, though temporary, manner; the same holds true for the wadding and gusset material. Only when the final primary joint 56 and its coplanar net of joints and struts are attached to the other mating face 57 of the secondary edge are the final rigid connections made through the three struts 58, two layers of wadding material and two gusset elements. Then, as with the simple concave edge, I nail metallic straps 59 across the interiors of the connected struts for protection against the bolts working themselves loose.

The triple concave edge 18 is formed from four interconnected homohedral struts FIG. 25: two primary edges and two secondary edges. As before, the two secondary edges are "wedged" in between the two tangent primary edge faces 55 so that all four edges are tangent, leaving two primary faces 52 to comprise the triple concave surface 18 of the structure. Three gusset elements 44 are used in the strut complex, along with three lengths of wadding material: each element and length is sandwiched within each of the planes of interconnection 51. The joints are positioned as seen in FIG. 24 and will be interconnected in succession, as was done with the double concave joint grouping FIG. 22. A difference will be in that "mirror image" secondary joints 35*a* and 35*b* will be connected together so that there will be symmetry in the order of the struts going into the cluster, if and only if non-bevelled ends are used on the secondary struts. Also there will be two patterns the bolts will take in passing through the struts 61 and 62, which will mean that three of the struts will be rigidly connected before the fourth need be added. Then, as with the simple and double concave edge clusters, I nail metallic straps 63 across the interiors of the connected struts for protection against the bolts working themselves loose.

A homohedral building framework is quite rigid in itself, but when rigid planar triangular panels (see FIG. 26-64) are added to enclose its surface, the structure becomes reinforced to a considerable degree. In fact such a triangulated building could be considered the strongest of types using comparable building materials. The triangular panels 64 that are attached to the surface of the building's framework can be constructed by many different methods, one of them being to use an internal structural framework supporting a pair of less rigid surface veneers; and out of many different materials, ranging from metals and fiberglass to wood. I prefer to use ½ inch thick plywood panels on my structures. These panels also have one common characteristic: the surfaces 65 with which they will be attached to the framework are identical equilateral triangles. This characteristic is true for any homohedral building of a uniform strut length. But the edges of the triangular panels will differ in accordance to whether they are tangent with a convex edge 3 or a single 16, double 17 or triple 18 concave edge. FIG. 26 shows an equilateral triangular panel with its plane of attachment exposed 65. It is a panel that will fit on an area bounded by three convex edges 3. FIG. 27*a* shows a cross section of the same panel revealing the bottom 65 and top 66 surfaces and the convex bevel 67 of the edge, which, when measured from its top surface, is one half the angle of the convex edge 3 of a homohedral structure. In the same manner, FIG. 28*a* shows the top 66 and bottom 65 surfaces and the concave bevel 68 on an edge of a triangular panel that will be tangent with a simple concave edge 16. Its concave bevel, when measured from its top surface, is one half the concave angle of the concave edge 16 on that portion of a homohedral structure. FIG. 29*a* shows the top 66 and bottom 65 surfaces and double concave bevel 69 on an edge of a triangular panel that will be tangent with a double concave edge 17, the concave bevel, when measured from the top of the panel, being one-half the concave angle 17 on the structure's surface. FIG. 30*a* shows the top 66 and bottom 65 surfaces and triple concave bevel 70 on an edge of a triangular panel that will be tangent with a triple concave edge 18, with its concave bevel, when measured from the top of the panel, being one-half the conncave angle 18 on the structure's surface. There are twelve panel variations possible on any homohedral building, so if the panels are to interfit along their bevelled edges, an inventory of twelve panel variations with the following edges is necessary:

1. Three convex edges.
2. Two convex and one simple concave edges.
3. One convex and two simple concave edges.
4. Three simple concave edges.
5. Two simple concave and one double concave edges.
6. One simple concave and two double concave edges.
7. Three double concave edges.
8. Two double concave and one convex edges.
9. One double concave and two convex edges.
10. One triple concave and two convex edges.
11. One triple concave and one simple concave and one convex edges.
12. One triple concave and two simple concave edges.

This problem of multiplicity can be surmounted by using a standard equilateral triangular panel with 90° edges (dotted line 71); the panel's bottom surface being of such an area that it will have its 90° edges 72 tangent with the convex edges throughout a triangular perimeter consisting of convex edges (see FIG. 27*a*). This is the largest a 90° edged triangular panel would have to be, and therefore is the standard 90° panel for any given building.

When two panels have one each of their 90° bottom edges tangent with the other along a convex strut surface, and edging strip FIG. 27*b*-74 can be fitted between the 90° edges to complete the surface edge. In a similar manner, a standard 90° edged panel can be shortened by cutting off a side of the panel slightly 71 so that the top 90° edge 73 is identical in length to the top edge as it would appear on a simple concave bevel FIG. 28*a*-68, the amount depending upon the thickness of the panel, thereby creating a slightly smaller equilateral triangular panel. When two such panels meet on a simple concave edge 16 of the structure, the top panel edges 73 will be tangent and a gap will be left to be filled by an interior edging strip or wadding element FIG. 28*b*-76 from the structural surface 72 to the tangent panel surfaces 73. The double concave bevel is treated similarly. The standard 90° edged panel is shortened to be used in place of the double concave bevel FIG. 29*a*-69 by cutting off a larger portion of one of its edges 71 and thereby making it a smaller equilateral triangle. When two such modified panels are fitted together, edgewise on a double concave edge, their trimmed 90° top edges 73 will be tangent, leaving a gap to be filled by an interior edging strip or wadding element FIG. 29*b*-76 from the structural surface 72 to the co-tangent surface edges on the panel 73. A substantial amount of an edge 70 must be cut off when preparing a standard 90° panel for a triple concave edge FIG. 30*a*. The gap left between the co-tangent surface edges 73 and the structural surface itself 72 is large enough to warrant the exclusive use of an interior edging strip FIG. 30*b*-77.

Even though all of these edging modifications cause the triangular panels to be less than identical equilateral, when their tangent inner surfaces 65 are combined with the coplanar surface on the wedging material 78 running down to the actual concave edge on the strut cluster, the composite surface is an exact coplanar equilateral triangle identical to all other composite coplanar panels, be they forming convex or concave edges. I prefer to attach both the panels and the edging materials with nails to the structural surface. The addition of the triangular panels, though not being the sole source of rigidity for a homohedral building, is an important enhancer of the structure's strength and rigidity.

There is one more aspect of homohedral building construction. It has to do with the expandability of any individual homohedral building. As stated before, any convex pentacap 4 outlines on its perimeter 6 an area for expansion-type interconnection. All that need be done is to have the pentacap removed leaving a pentangular coplanar face 7 left on the surface of the structural elements. The series of drawings FIGS. 31–34 shows how a basic expansion is effected. FIG. 31 shows a simple homohedral building composed of one triple truncated icosahedron 11 and three single truncated icosahedra 8. In FIG. 32 two pentacaps 4 are removed from one of the single truncated icosahedra, thereby making it a triple truncated icosahedra. Attached to the two exposed pentangular faces are two more single truncated icosahedra FIG. 33-8, resulting in a new expanded homohedral building consisting of six truncated icosahedra FIG. 34.

To effect this expansion as simply as possible, detachable pentacaps should be built into the original building wherever a line of expansion might be pursued. These pentacaps would be normally attached to the building framework along primary joints and primary strut faces, though secondary joints and secondary strut faces in some instances could be used, so that when they're removed the proper mating faces are available for interconnection with other homohedral structural elements. The detachable pentacap I use is composed of a set of five specialized mating joints FIGS. 37*a* and *b*-79 and struts FIGS. 35*a* and *b*-80 along with one convex joint 33 and five standard homohedral struts 29. The detachable cap joint has a surface composed of two equilateral triangular planes 36 and one regular pentangular plane 38 from which four angles have been cut off or modified by a diagonal truncation. These three planes are clustered so that a vertex forming joint is produced. A depression 37 is made on the surface of the joint 79, along and on either side of the edge formed between the two equilateral triangular planes, so that a homohedral strut may be placed snugly into the depression with its primary edge and sides tangent with the surface of the depression and its convex edge and side continuous with and completing of the convex surface of the joint existing along and on either side of the edge shared 3 by the two equilateral triangular surfaces.

On the other two edges 82, shared by the equilateral triangular surfaces 36 and the truncated pentangular surface 38, are also situated depressions. Into these two depressions 81 will fit snugly two detachable cap struts so that their edges 82 and surfaces 83 continue and complete the surfaces of the joint existing along and on either side of the edges shared by the triangles and the truncated pentagon 82. This strut edge 82, when made tangent with the primary edge 14 on a homohedral strut, so that one each of their respective faces is coplanar FIG. 36, produces a composite edge identical to a convex 3 homohedral strut edge. Similarly, when the truncated pentangular faces 38 on both the primary joint 34 and the detachable cap joint 79 are made coplanar and interconnected FIG. 38, the composite joint is nothing more than a regular convex joint 33. Both the detachable cap strut and joint are made of materials with which the other struts and joints are made; and with apertures compatible to those appearing on the other struts and joints. When the cap framework is attached to the main framework no gussets are needed, since a convex vertex is formed, but wedge-shaped wadding material will be necessary for a proper edge seal. Also the cap should be attached to the primary edge or faces so that it can easily be detached. This may mean special placement of the connecting bolts and nuts 84 and perhaps the attachment of the triangular surface planes with screws instead of nails.

Since most homohedral buildings have convex vertices 85 for their bases, a modification of some convex vertex joints is in order. The modifications are made so that such convex joints can be used as attachment and securing means for a homohedral building to its foundation FIG. 39. To realize this a convex joint is fitted with an elongate structural member 86 — column or beam — that encompasses the vertex of the joint and is rigidly connected thereto. This member can be buried, cemented or bolted to an immovable base on the ground, thereby making the homohedral building secure in any wind load and also less susceptible to damage by earth tremors and the like, while keeping the triangular panels attached to the surface framework slightly elevated in relation to the ground level. Stamped or rolled steel, creosoted wood of sufficient diameter and strength and reinforced concrete immediately come to mind as materials to be considered for use in the columns or beams. I prefer to use reinforced concrete columns, rigidly and permanently attached to the convex joints, for my load-bearing members. These columns or beams will not necessarily be perpendicular to the ground level in their final working positions, but rather pitched at varying angles to the perpendicular, depending upon the design of the structure they will be used in.

Finally, a special triangular surface panel FIG. 40 will be used, with from one 87 to three truncated vertices — depending upon the proximity of the load-bearing column-joint composites — so that the panel fits flushly against the edge or side of the load-bearing member 88 when it is attached to the structural framework.

As should be obvious, the terms, expressions and phrases that I have adopted are used in a descriptive rather than a limiting sense. I have no intention of excluding such equivalents of the invention described, or of portions thereof, as fall within the scope of the claims.

I claim the following:

1. A structural framework in which the main structural elements comprise at least three icosahedral members, each icosahedral member being truncated about a vertex by the removal of five icosahedral faces about said vertex and at least one of said three icosahedral members being truncated about at least two non-adjacent, non-opposing vertex points, said truncated icosahedral members being joined along planes of truncation thus formed.

2. A structural framework as claimed in claim 1 in which the joined icosahedral members are formed by a set of elongate structural elements, each structural element possessing a means of attachment to other similar structural elements.

3. A structural framework as claimed in claim 2 in which the elongate structural elements occurring along the joined planes of truncation are joined by gusset members.

4. A structural framework as claimed in claim 3 in which said gusset members are pentacap members consisting of five said elongate structural elements connected to one another at one of their respective ends, and one to each vertex occurring along said joined planes of truncation at their other ends.

5. A structural framework as claimed in claim 2 in which said means of attachment among said elongate structural elements comprises a set of vertex forming joint members.

6. A structural framework as claimed in claim 5 in which said elongate structural elements are all identical in length.

7. A structural framework as claimed in claim 6 in which the vertex forming joint members are a set of identical vertex forming joint members.

8. A structural framework as claimed in claim 3 in which said gusset members are elongate elements substantially shorter than said elongate structural elements, each gusset member being attached to said elongate structural elements occurring along the joined planes of truncation on either side of each vertex so as to form a triangular brace.

9. A structural framework as claimed in claim 1 in which said icosahedral members are formed by a set of triangular planar structural elements possessing a means of attachment to one another along their peripheral edge surfaces.

10. A structural framework as claimed in claim 9 in which the planar structural element edges that occur along the planes of truncation are joined by gusset members.

11. A structural framework as claimed in claim 10 in which the triangular planar structural elements are equilateral triangular planar structural elements.

12. A structural framework as claimed in claim 11 in which the gusset members comprise an interconnected cluster of five planar structural elements identical to said planar structural elements, forming a common vertex at their converging apices and a pentangular coplanar line segment at their adjoining bases said gusset, being attached by way of its adjoining bases to the structural element edges that occur along the joined planes of truncation.

13. A structural framework as claimed in claim 12 in which the means of attachment of said adjoining bases of said gusset members is such that at least one set of planar structural element edges that occur along the planes of truncation are parallel and tangent to the adjoining base surfaces on said gusset members.

14. A structural framework as claimed in claim 1 in which said icosahedral members are formed by a combination of elongate and planar structural elements: the elongate elements being joined to one another through a series of vertex forming joint elements, the planar elements being joined to adjacent triangular surfaces formed by the joined said elongate elements in such a way that outer surfaces of the planar elements are coplanar with the outer surfaces of said adjacent elongated elements.

15. A structural framework as claimed in claim 14 in which said elongate structural elements are all identical in length.

16. A structural framework as claimed in claim 14 in which each of said planar structural elements has a bottom mating surface in the form of an equilateral triangle.

17. A structural framework as claimed in claim 16 in which edges on said planar structural elements are bevelled at 90° to the planar surfaces.

18. A structural framework as claimed in claim 16 in which said planar structural elements have top surface edge angles that are each one-half of a dihedral angle present on an edge of an adjacent elongate structural element to which the planar element edge is adjoined.

19. A structural framework as claimed in claim 18 in which said edge of said elongate structural element is an edge formed by a cluster of elongate structural elements and their edges.

20. A structural framework as claimed in claim 14 in which the structural elements occurring along the joined planes of truncation form five angles among themselves which are gusseted.

21. A structural framework as claimed in claim 20 in which the gusseting is achieved by five gusset elements that are sandwiched between and attached to the joined truncated icosahedral members.

22. A structural framework as claimed in claim 14 in which provisions are made on some of said vertex forming joint elements for attachment of load-supporting elongate members.

23. A structural framework as claimed in claim 1 in which at least one of said icosahedral members has an unused plane of truncation to which no other icosahedral member is joined.

24. A structural framework as claimed in claim 23 in which said unused plane of truncation has a means for attaching additional icosahedral members.

25. A structural framework as claimed in claim 24 in which a pentacap element is provided for attachment to said unused plane of truncation, said pentacap comprising five faces of an icosahedral member joined about a single vertex.

26. A structural framework as claimed in claim 1 in which the icosahedral members are formed by a series of interconnected elongate structural elements and vertex forming joint elements whose major convex edges are substantially identical in angular configuration to edges on an icosahedron from which two sets of five icosahedral faces about two non-adjacent and non-opposing vertex points have been removed by planar truncations.

27. A structural framework as claimed in claim 26 in which said elongate structural elements are of three types:

1. convex edge type, with its major convex edge identical in angular configuration to a convex edge as it occurs between two triangles on an icosahedron,
2. primary mating edge type, with its major convex edge identical in angular configuration to a convex edge as it occurs between a triangle and a pentagon on said truncated icosahedron, and
3. secondary mating edge type, with its major convex edge identical in angular configuration to a convex edge as it occurs between two pentagons on said truncated icosahedron.

28. A structural framework as claimed in claim 26 in which the vertex forming joint elements are of three types:

1. convex joint type, with its five major converging convex edges each identical in angular configuration to a convex edge as it occurs between two triangles on an icosahedron,
2. primary joint type, with its four major converging convex edges identical in angular configuration to a set of converging convex edges as they occur among a vertex forming cluster of three triangles and a pentagon on said truncated icosahedron, and
3. secondary joint type, with its three major converging convex edges identical in angular configuration to a set of converging convex edges as they occur among a vertex forming cluster of two pentagons and a triangle on the surface of said truncated icosahedron.

29. A structural framework as claimed in claim 28 in which said vertex forming joint elements have convex edges and a depression along each convex edge so that the end of an elongated structural element can be attached to the vertex forming joint element at the location of said depression to form a uniform extension of each said convex edge of said vertex forming joint element.

30. A structural framework as claimed in claim 29 in which the elongate structural elements are of identical length.

31. A structural framework as claimed in claim 26 in which said elongate structural elements are of identical length, some of said elongated structural elements having four parallel convex edges running lengthwise on each structural element: one of the edges being substantially identical in angular configuration to a convex edge as it occurs between two triangles on an icosahedron, two flanking edges each being substantially identical in angular configuration to a secondary mating edge as it occurs between two pentagons on said truncated icosahedron, and an opposite edge being substantially identical in angular configuration to a primary mating edge as it occurs between a triangle and a pentagon on said truncated icosahedron.

32. A structural framework as claimed in claim 26 in which the icosahedral members are formed by the elongate structural element's interconnection through a series vertex forming joint elements, and are joined to one another by way of their interconnected elongate structural element-vertex forming joint element surface planes, primary edge to primary edge, primary edge to secondary edge and secondary edge to secondary edge.

33. A structural framework as claimed in claim 31 in which some of said elongate structural elements are of triangular cross section with one triangular edges being equal to the secondary mating edge as it occurs between two pentagons on a truncated icosahedron.

34. A structural framework as claimed in claim 33 in which the triangular elements are beveled at both ends.

35. A structural framework as claimed in claim 32 in which wedge shaped elongate material is sandwiched between the joined icosahedral members to complete a dihedral angle generated by the joined main structural elements.

36. A structural framework as claimed in claim 1 in which said joined icosahedral members form a helix.

37. A structural framework as claimed in claim 1 in which said joined icosahedral members form a circle.

* * * * *